United States Patent [19]

Seino et al.

[11] 4,063,811

[45] Dec. 20, 1977

[54] ELECTROPHOTOGRAPHIC COPIER

[75] Inventors: Kuniki Seino, Kawasaki; Shoji Kondo, Tokyo, both of Japan

[73] Assignee: Minolta Camera Kabushiki Kaisha, Japan

[21] Appl. No.: 675,345

[22] Filed: Apr. 9, 1976

[51] Int. Cl.[2] ..... G03G 21/00

[52] U.S. Cl. ..... 355/15

[58] Field of Search ..... 355/3 R, 3 TE, 3 CH, 355/15; 96/1 TE, 1 C, 1.5

[56] References Cited

U.S. PATENT DOCUMENTS

| | | | |
|---|---|---|---|
| 3,147,679 | 9/1964 | Schaffert | 355/3 TE |
| 3,494,789 | 2/1970 | Makino | 96/1.5 |
| 3,625,683 | 12/1971 | Emerson | 355/15 |
| 3,649,262 | 3/1972 | Cade et al. | 355/15 |
| 3,879,785 | 4/1975 | Roth et al. | 355/15 |
| 3,884,572 | 5/1975 | Bacon et al. | 355/15 |
| 3,918,808 | 11/1975 | Narita | 355/15 |
| 3,967,891 | 7/1976 | Rippstein | 96/1 C |

*Primary Examiner*—William M. Shoop

*Attorney, Agent, or Firm*—Watson, Cole, Grindle & Watson

[57] ABSTRACT

An improved electrophotographic copier is disclosed. The copier includes a rotatable photosensitive member, a first charging means for charging the photosensitive member uniformly with a specific polarity of charges to a predetermined surface potential, an image exposing means for exposing the uniformly charged photosensitive member, an image transfer means for transferring an image onto a copying material and an erasing means for erasing charges on the photosensitive member after transfer by the image transfer means, the improvement which comprises that said photosensitive member is of material which exhibits a hysteresis effect in which the photosensitivity of the photosensitive member when exposed by said image exposing means varies in accordance with the variance of the surface potential at the start of light decay by said erasing means, and a second charging means is provided at a position preceding said erasing means for uniformly applying charges of a polarity the same as the polarity of said first charging means to the photosensitive member.

3 Claims, 13 Drawing Figures

ELECTROPHOTOGRAPHIC COPIER

BACKGROUND OF THE INVENTION

This invention is related generally to an electrophotographic process and apparatus, and is more particularly concerned with improvements in an electrophotographic process of the type in which an electrostatic latent image is formed in conformity with a pattern on an original to be copied subsequent to the sequential steps of neutralizing any residual charges on the surface of an endless photosensitive member by using an eraser lamp, charging the surface of the endless photosensitive member, and projecting an optical image onto the charged surface of the photosensitive member in conformity with the pattern on the original.

Recently, there have been developed in the field of electrophtography, processes wherein electrophotographic copying machines use a latent image transfer system. An electrostatic latent image in conformity with a pattern on an original to be copied is formed on the surface of a photosensitive member, after which, the electrostatic latent image is transferred onto a sheet of copy paper. The copy paper is then developed to make the image thereon visible.

In general, a latent-image-transfer type of copying machine using an electrostatic latent image transfer system dispenses with a cleaning device for removing residual toner which is clinging to the surface of the photosensitive member in contrast to a copying machine adopting a developed toner image transfer system. Therefore, the former system permits the use of an endless photosensitive member of a drum type having a small diameter, e.g., on the order of 60 mm, and presents a simple structure and easy maintenance. In addition, the former system further provides an advantage in that the copy paper to be used may be of a type which is similar to a plain paper yet producing a copy of high quality in contrast to a copying machine embodying an Electrofax type of system. The latent-image-transfer type of copying machine retains all of the aforesaid numerous advantages and, thus has achieved an excellent reputation in the field of electrophotographic copying machines.

However, in practical applications of the electrostatic-latent-image-transfer type of copying machine, a problem is posed. Particularly in those instances where an endless photosensitive member of the drum type having a diameter of about 60 mm is used, a stained copied pattern or image results. The character of the stain depends on the specific photosensitive materials and processes for manufacturing those photosensitive materials which are employed. The staining results in an accompanying lowering in quality of the copy obtained.

This will be described in more detail hereinbelow. In the case of an endless photosensitive member of the drum type having a diameter of about 60 mm as is used commonly in an electrostatic-latent-image-tranfer copying machine, the outer circumference of the drum is about 190 mm. Therefore, the drum photosensitive member must be rotated at least one full turn to complete the copying of a sheet of an original so that often a portion of the surface of the drum photosensitive member must be used repeatedly. More particularly, during the copying of a sheet of A4 size, (the length of an A4-size sheet is 297 mm) about 60% of the peripheral surface of the drum photosensitive member must be used twice. Accordingly, the first portion of a copy produced by the machine (the portion of a copied pattern corresponding an electrostatic latent image formed on the photosensitive member during the first rotational cycle of the drum photosensitive member) is subject to fogging. (This will be referred to hereinafter as a foggy effect.) In addition, a later portion of the copy (the copied pattern corresponding to an electrostatic latent image formed on the photosensitive member during the second cycle of rotation of the drum photosensitive member, i.e., a latent image formed on the repeatedly used surface of the photosensitive member) exhibits a superimposed copied pattern of that of the beginning half of a copy. (This will be referred to hereinafter as a "memory" effect.) Still in addition, stains of a mesh form appear in the middle portion of the copy.

SUMMARY OF THE INVENTION

It is, therefore, a principal object of the present invention to provide an improved electrophotographic process and apparatus which can provide a copied pattern or image of high quality.

It is a further object of the present invention to provide an electrophotographic process and apparatus which prevents the occurrence of a stained copied pattern as experienced with the prior art electrophotographic processes.

It is a still further object of the present invention to provide an electrophotographic process and apparatus which is well suited for use with a $CdS{\cdot}nCdCO_3$ resin photosensitive member.

It is a even further object of the present invention to provide an electrophotographic process which is highly suitable for use in an electrophotographic copying machine employing a drum type of endless photosensitive member having a small diameter.

It is another object of the present invention to provide an electrophotographic process which is well adapted for use in an otherwise conventional electrostatic-latent-image-transfer type copying machine.

These and other objects and features of the present invention may be readily attained in an electrophotographic process of the general type which includes the steps of neutralizing any residual charges on the surface of an endless photosensitive member by using an eraser lamp, charging the surface of the endless photosensitive member, projecting an optical image in conformity with a pattern of an original onto the surface of the charged endless photosensitive member thereby forming an electrostatic latent image on the surface of the endless photosensitive member in conformity with the pattern of the original. When performed in accordance with the present invention, the aforesaid process is characterized by inclusion of the step of rendering the distribution of charges on the surface of the endless photosensitive member uniform prior to the aforesaid step of neutralizing any residual charges on the surface of the photosensitive member by using an eraser lamp. Stated otherwise, the aforesaid step for rending the distribution of charges uniform is practiced satisfactorily by using a charging means which charges the surface of the endless photosensitive member uniformly.

These and other objects, advantages and features of the invention will become apparent from the following description thereof, when read in conjunction with the accompanying drawing which illustrates various exemplary embodiments of the invention.

BRIEF DESCRIPTION OF THE DRAWING

FIGS. 2(A) through 2(F) are a series of cross-sectional views of the essential parts of an image-forming station of a conventional electrostatic-latent-image transfer copying machine adopting the prior art electrophotographic process, in which FIGS. 2(A)–(F) show the respective phases of copying operations of the copying machine at various sequential positions of the rotating operation of a drum type of endless photosensitive member;

In the following description, like parts are designated by like reference numerals throughout the several FIGS. of the drawing.

DETAILED DESCRIPTION OF THE PREFERRED EMBODIMENTS

The inventors have made various tests of the electrophotographic characteristics of a photosensitive member which has been prepared by dispersing throughout a thermosetting resin photoconductive particles $CdS \cdot nCdCO_3$ ($0 < n \leqq 4$), i.e., photosensitive materials which are responsible for a stained copied pattern, which materials consist of cadmium sulfide and cadmium carbonate (This photosensitive member will be referred to hereinafter as a $CdS \cdot nCdCO_3$ resin photosensitive member.) followed by heat setting. This photosensitive member is such as disclosed in the U.S. Pat. No. 3,494,789, the teachings of which are expressly incorporated herein by reference.

Figure 1:
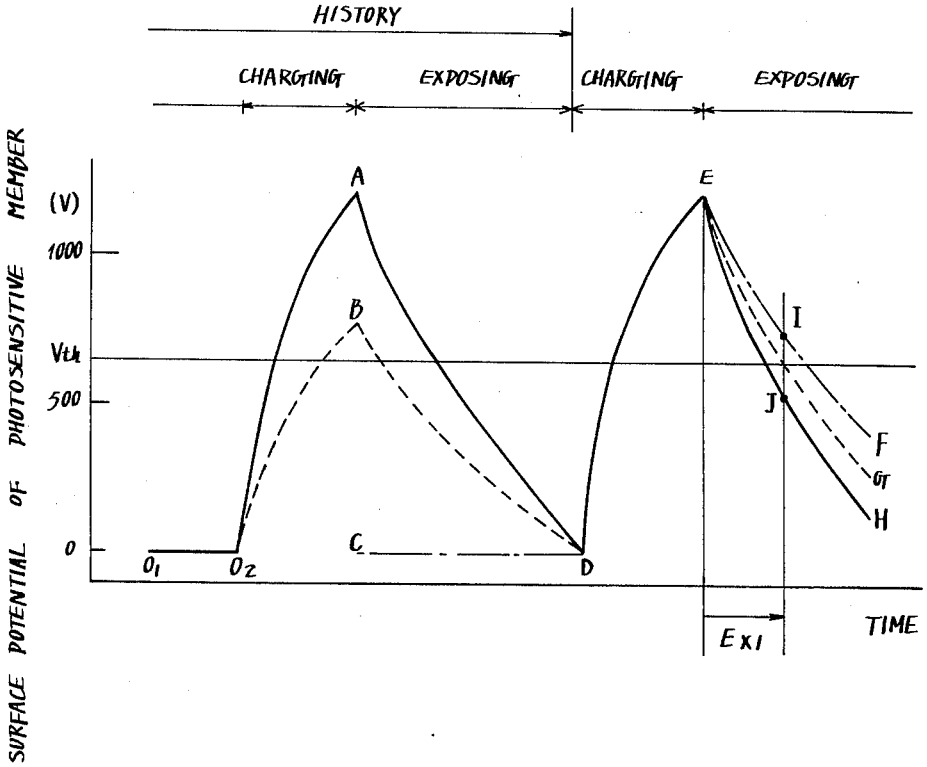
FIG. 1 is a plot showing the electrophotographic characteristics of a $CdS \cdot nCdCO_3$ - resin photosensitive member.

As a result of these tests, as shown in FIG. 1, there has been discovered a hysteresis which is of an entirely different characteristic from any effects which have been reported previously. Any hysteresis of a photosensitive member has been considered previously to represent a fatigue effect. More specifically, it has been considered that, in the case where a photosensitive member is subjected to repeated charging and exposure, following these steps, the charged surface potential is lowered with a concomitant decrease in a charge capacitance. The light decay rate is lowered as well, as compared with the case where the photosensitive member is not subjected to repeated charging and exposing steps.

It has been found that, irrespective of whether or not the photosensitive member has been subjected to charging and exposure prior to the immediate sequence of charging and exposure steps, i.e., the history thereof, the $CdS \cdot nCdCO_3$ resin photosensitive member maintains a constant charge capacitance and allows charging to a constant surface potential all the time, but only if the charging condition is maintained constant.

There results a light decay rate having a relationship inverse to that of an ordinary photosensitive member in terms of history. In addition, it was also found that such a phenomenon takes place, remarkably, in those instances where the time interval between the previous exposure and the present exposure is less than 3 seconds. Furthermore, if the aforesaid time interval exceeds 10 seconds, there results little or no effect of such a phenomenon.

FIG. 1 is a graphical plot showing the relationship between the charge capacitance and the light decay rate of a $CdS \cdot CdCO_3$ photosensitive member with respect to its history. The time interval between successive exposures is set to be no less than 3 seconds for the $CdS \cdot CdCO_3$ resin photosensitive member. In this figure, the surface potential of the photosensitive member is represented on the ordinate, while the temporal relationship of the respective steps is represented along the abscissa. In addition, in FIG. 1, the noncharging of the $CdS \cdot CdCO_3$ photosensitive member as a preliminary step is also taken to be part of the history, this is represented by the C to D.

In FIG. 1, a solid line refers to a first variation in surface potential of the photosensitive member. In this case, the surface of the photosensitive member is charged to 1200 V and then is subjected to exposure. This sequence is identified, at the top of the Figure as the history. The broken line represents the situation where the surface of the photosensitive member is charged initially during its history to a potential of 757 V and is subjected then to exposure. The one point chain line refers to the case where the surface of the photosensitive member is free of any charges during the history portion of the sequence, but is subjected to the subsequent charging and exposure. It should be recognized immediately in this respect that, as shown by a point E in this figure, if the charging condition is maintained constant, then the charge capacitance, i.e., the initial surface potential to which the surface may be raised is maintained constant irrespective of the history. Next, it should be noted that where the surface potential at the starting point of exposure during the previous history is highest, the light decay rate is at a maximum during subsequent charging and exposure. This must be compared with the instance where the surface potential during the earlier history is lower.

Referring specifically to the graph, if the preceding history follows the course 01-02-A-D, i.e., a high potential during its history phase, then the succeeding sequence of charging and exposure follows the path D-E-H. On the other hand, if the preceding history follows the path 01-02-B-D, i.e., a lower potential is imposed during its immediate history, then the succeeding sequence of charging and exposure follows the course D-E-G. Finally, if the preceding history simply follows the line, i.e., no recent charging history, C-D, then the succeeding sequence follows the course D-E-F.

FIG. 1 represents the general electrophotographic characteristics of hysteresis of a $CdS \cdot nCdCO_3$ resin photosensitive member. Where the surface potential of such a photosensitive member is lowered for one reason or another prior to exposure, such as from point A to point B, regardless of the fact that the surface potential has been charged up to a high point A in its history, the $CdS \cdot nCdCO_3$ photosensitive member follows the course A-B-D-E-G rather than the course A-D-E-H. Conversely, if the surface potential is increased during its history such as from point B to point A, then the photosensitive member followers the course B-A-D-E-H upon a subsequent sequence of charging and exposure.

Now, the description will be turned to FIG. 2, each subfigure of which shows a cross-sectional view of the essential parts of an image forming station of a conventional electrostatic latent image transfer type of copying machine. The machine in each part of FIG. 2 embodies a prior art electrophotographic process. It is in connection with this type of machine and process that the occurrence of stained copy patterns generally results, the reasons for which have been clarified by the present inventors.

In this description, reference is also made to the characteristics of the $CdS \cdot nCdCO_3$ resin photosensitive member as shown in FIG. 1.

Referring now to FIG. 2, there is shown an endless photosensitive member 5 such as a drum. Typically, the member 5 is a metallic drum, has a diameter of about 60 mm and has its peripheral surface coated with the aforesaid $CdS \cdot nCdSO_3$ resin to an approximate thickness of 20 to 60 mm. Arranged successively around the photosensitive drum 5 are: a charging means 1 which usually consists of a corona discharger 1*a;* an exposure means 2 consisting typically of a light source 2*a* illuminating the original pattern and a projecting optical system, shown here as a lens 2*b;* a transfer means 3 consisting, in this embodiment, of a grounded transfer roller 3*a* which is made of an electroconductive sponge material or the like and which is brought into a pressing contact with the surface of the photosensitive drum 5; and a charge erasing means 4 for neutralizing charges on the surface of the photosensitive drum 5, which means may consist of an eraser lamp 4*a*.

Upon commencement of the copying sequence, a print button (not shown) is depressed thereby transmitting a copy starting signal to the copying machine. The photosensitive drum 5 starts rotating in the direction of the arrow at a peripheral surface speed of about 100 mm/sec. The eraser lamp is lit and, after a given lapse of time, the corona discharger 1*a* is then energized.

Figure 2A:
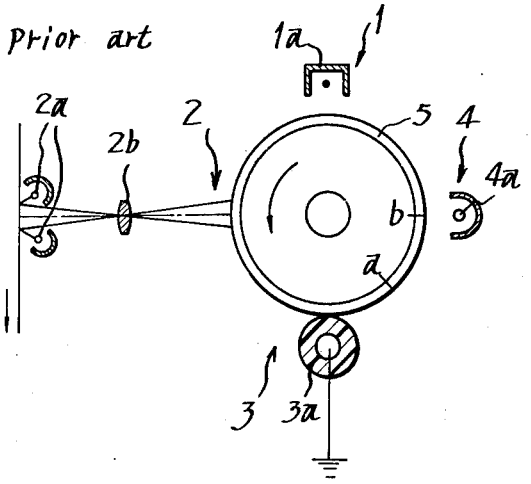
Figure 2B:
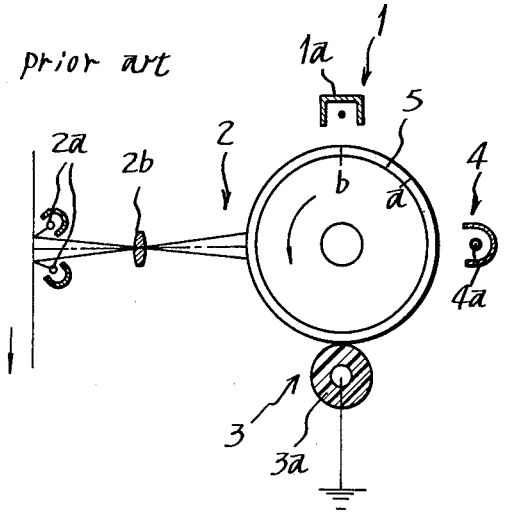
Figure 2C:
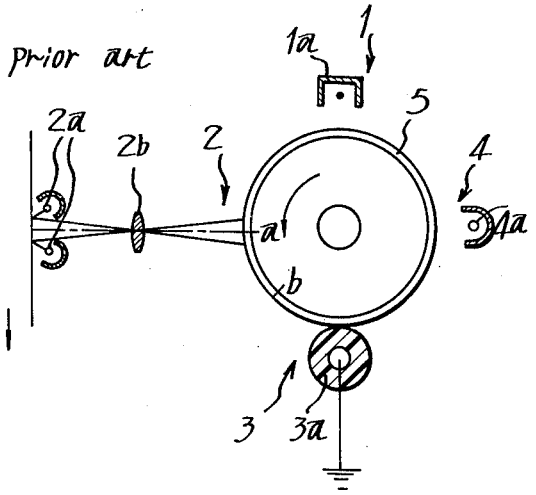

Description will now be given of the various aspects of the stained copied pattern and its relationship to the operation of the copying machine. This description is made with reference to the position *a* (the tip of the image forming portion on the photosensitive drum) and the position *b* (the tip of a portion to be charged) of the photosensitive drum 5 in the stopped condition of the photosensitive drum, as shown is in FIG. 2(A). When the print button is depressed, the photosensitive drum 5 starts to rotate, the position *b* comes immediately below the corona discharger 1*a,* at which time the corona discharger 1*a* is energized thereby starting to charge the surface of the photosensitive drum 5. This is shown in FIG. 2(B). Subsequently, when the point *a* reaches a position below the exposure means 2, as shown in FIG. 2(C), the light source 2*a* illuminating the original pattern is turned on. A light pattern representative of an original is sequentially projected through a projecting optical system 2*b* onto the surface of the photosensitive drum 5 forming an electrostatic latent image.

Figure 2D:
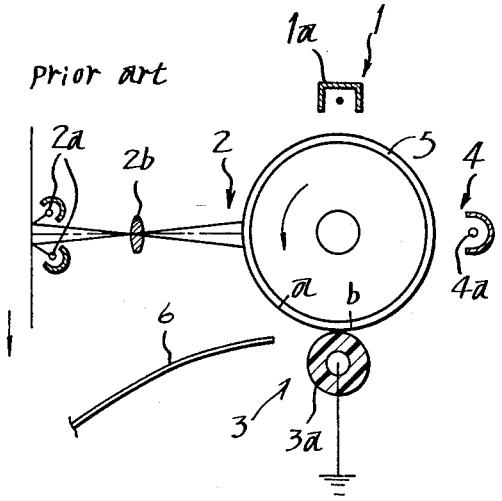
Figure 2E:
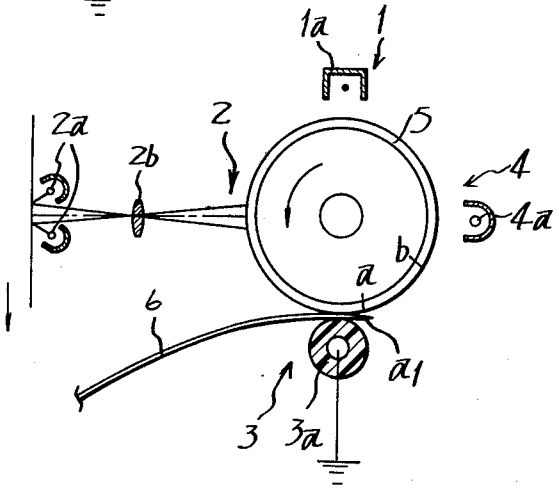
Fig.2(E) Prior art

When the photosensitive drum 5 is further rotated, and the position *b* passes a small distance beyond the position of contact between the transfer roller 3*a* and the drum 5, as shown in FIG. 2(D), then the charges in the charged portion of the surface which is confined between the position *a* and the position *b* of the surface of the photosensitive drum 5 are erased through the electrically grounded transfer roller 3*a*. When the position *a* contacts the transfer roller 3*a* a sheet of copy paper 6 is inserted between the transfer roller 3*a* and the photosensitive drum 5 and the electrostatic latent image formed on the surface of the photosensitive drum 5 transferred onto the transfer copy paper 6 as shown in FIG. 2(E). Next, the surface of the photosensitive drum 5 is irradiated by the light from the eraser lamp 4*a*. That portion of the surface of the photosensitive drum which has been used as an image forming portion during the first cycle of rotation of the drum 5 by being charged by means of the corona discharger 1*a* is now used again during the production of a single copy.

Figure 2F:
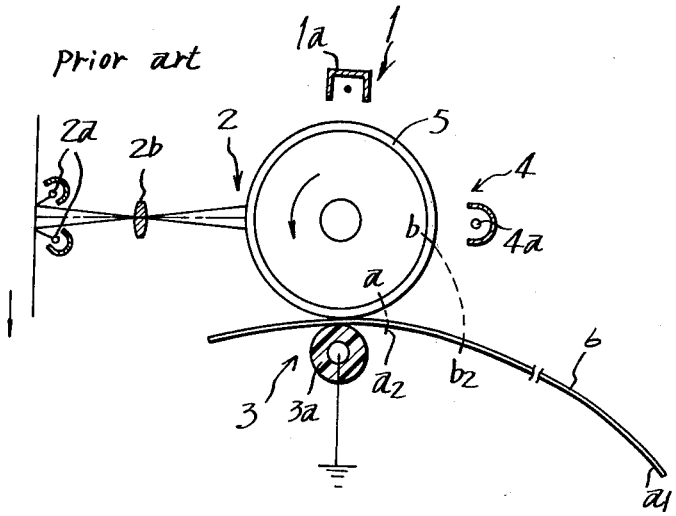
Fig.2(F) Prior art

FIG. 2(F) depicts the condition prior to the completion of transfer of the electrostatic latent image from the surface of the photosensitive drum 5 onto the transfer copy paper 6. In this figure, the tip *a,* of the transfer paper 6 corresponds to the position *a* on the drum 5 during the first cycle of rotation of the drum. The points $a_2$ and $b_2$ correspond to the positions *a* and *b* on the drum surface in the second cycle of rotation of the drum. Accordingly, the area of the transfer paper 6 which is confined by the points $b_2$ and $a_2$ correspond to the portion *a-b* of the surface of the photosensitive drum 5 in the second cycle of rotation of the drum, the aforesaid area being that which has been discharger by the corona charger 1*a* during the first cycle of rotation of the photosensitive drum 5 and then erased through the grounded transfer roller 3*a*.

A study of copied patterns which have been obtained by developing the electrostatic latent images thus transferred onto the transfer copy paper 6 according to a suitable developing means reveals that the copied pattern ranging from the point $a_1$ to the point $b_2$ on the surface of the transfer copy paper 6 has a "fogging" phenomenon throughout the entire area thereof. In contrast, a copied pattern in the area extending from the point $a_2$ and beyond has no fogging. A copied pattern ranging from the point $b_2$ to the point $a_2$ exhibits stains in the form of a black mesh pattern. Finally, a copied pattern extending from the point $a_2$ and beyond exhibits a superimposed copied pattern of the pattern ranging from the point $a_1$ to the point $b_2$ on the transfer paper, i.e., the electrostatic latent image carried by the same area on the drum 5 during the initial revolution.

According to the mechanism of an electrostatic latent image transfer as described in the publication entitled ELECTROPHOTOGRAPHY by SCHAFFERT, (published by Focal Press Co., Ltd.) the surface potential $Vt$ of the transfer paper after the transfer of the electrostatic latent image, as well as a transfer critical value or a potential $Vth$ (potentials higher than $Vth$ enable the transfer of images) are given as follows:

$$Vt = Xd/Xp + Xd\,[Vs - Vth]$$

$$Vth = 87.96\,(Xp + Xd)^{\frac{1}{2}} + 312 + 6.2\,(Xp + Xd)$$

$$Xp = Lp/Kp\;Xd = Ld/Kd$$

Vs: surface potential on the photosensitive member
Lp: thickness of the photosensitive layer on the photosensitive member
Kp: dielectric constant of the photosensitive layer of the photosensitive member
Ld: thickness of the insulating layer of transfer paper
Kd: dielectric constant of the insulating layer of transfer paper On the other hand, a decrease $\Delta V_s$ in the surface potential of the photosensitive member after the transfer of the electrostatic latent image is given to be:

$$\Delta Vs = Xp/Xp + Xd\,[Vs - Vth]$$

Now, assume that the following example is given:

$Xd = 2$ [447 pF/cm²](electrostatic capacitance of the transfer paper)

$Xp = 6$ [148 pF/cm²](electrostatic capacitance of the photosensitive member)

$Vs = 1200$ V.

Then $Vt = 148$ V $\Delta Vs = 443$ V $Vth = 610$ V.

For a better understanding of the phenomenon of a stained copied pattern, the foregoing numerical description may be beneficial in combination with suitable reference to FIG. 1.

1. The area ranging between the points $a_1$ and $b_2$ on the surface of the transfer copy paper 6:

The area extending from the point $a_2$ and beyond on the surface of the transfer paper 6 corresponds to the area of the surface of the photosensitive drum 5 which has traced an immediate history of exposure to charge neutralizing by the eraser lamp 4*a*, charging by discharger 1*a*, exposure to a projected optical image pattern, transfer, exposure to a second charge neutralizing, a second charging and a second exposure to a projected optical image pattern. The characteristics of the history of drum 5 are expressed by the solid curve 01-02-A-D-E-H in FIG. 1. In contrast thereto, the area ranging between the points $a_1$ and $b_2$ on the transfer paper 6 corresponds to the area of the surface of the drum 5 which has traced a history of exposure to charge neutralizing, excluding an initial charging, followed by a subsequent charging and exposure to a projected optical pattern. Here, the characteristics of the drum are given as the curve C-D-E-F of FIG. 1.

In other words, there is a significant difference in the light decay rate which is an important image forming characteristic. Since the light decay rate is particularly low in those cases where the history excludes a charging step, the area extending from the point $a_1$ to the point $b_2$ has a history of the higher charges associated with an electrostatic latent image as compared with those in the area ranging from the point $a_2$ and beyond. This results in a difference in density between the two areas, and the accompanying fogging in the area $a_1$ to $b_2$.

Considering the time sequence after the second exposure in terms of the exposure value, let us assume that the optimum exposure value for the white portion of a pattern corresponding to the area ranging from $a_2$ and beyond is $E_{xl}$. During this period, the potential of an area which has traced a history including charging is lowered to the point J, i.e., below $Vth$ (610 V), while the potential of the area which has traced a history free of charging is lowered only to the point I which is above $Vth$. Therefore, a small quantity of electrostatic charges is transferred to the transfer paper presenting fogging on the copied pattern.

The above description however should be supplemented to some extent. The history of the area ranging from point $a_2$ and beyond is explained merely as a series of steps, i.e., exposure to charge neutralizing, charging, exposure to a projected optical image pattern, and exposure to charge neutralizing. However, the practical application of the process involves a step of transfer of an electrostatic latent image to the copy paper leading to a lowering of the surface potential after the exposure to a projected optical image pattern; however, such lowering is not remarkable and is omitted at this time for simplicity of description. This step, however, should be deemed important with reference to the description (3) to be given hereinafter.

2. The area of the surface of the transfer copy paper ranging from $b_2$ to $a_2$: This area corresponds to the area of the photosensitive drum which has traced a history of exposure to charge neutralizing, charging, erasure of charge through the ground transfer roller, and exposure to charge neutralizing followed by charging and exposure to a projected optical image pattern. In this respect, since an electroconductive sponge roller is usually used as the transfer roller 3*a*, there results a nonuniformity in the erasure of charges due to the surface pattern of a spongy material. The area which has not been subjected to the erasure of charges presents the same characteristic as that of an area which has traced a history of exposure to charge neutralizing, charging and exposure to charge neutralizing, i.e., the characteristic represented by a curve 01-02-A-D-E-H. On the other hand, the area having charges erased by the grounded transfer roller presents the same characteristic as that of an area which has traced a history of mere exposure to charge neutralizing, excluding the charging step, i.e., the characteristic represented by a curve C-D-E-F. Therefore, there is produced a black mesh pattern in the copied pattern in conformity with the surface pattern of the spongy material of the transfer roller.

3. The area ranging from the point $a_2$ and beyond on the surface of a transfer copy paper:

This area corresponds to that area of the surface of the photosensitive drum, which has traced a history of exposure to charge neutralizing, charging, exposure to a projected optical image pattern, reduction of the surface potential due to transfer of an electrostatic latent image, exposure to charge neutralizing and a second charging and exposure to a projected optical image pattern. In this respect, separate consideration should be given to the area which maintains a charged surface potential without being subjected to exposure (the area corresponding to the black portion of an original pattern), and the area having its charges neutralized due to exposure (the area corresponding to the white portion of an original pattern).

The area which has not been subjected to exposure presents the same characteristic as that of an area which has traced a history of exposure to charge neutralizing, charging, lowering of a surface potential due to transfer of an electrostatic latent image, and exposure to charge neutralizing. That is, the characteristic represented by a curve 01-02-A-B-D-E-G. (The reduction of the surface potential due to the transfer of an electrostatic latent image at a potential of 1200 V is approximately 443 V.) On the other hand, the area which has been subjected to exposure presents a negligible reduction of potential due to the transfer of an electrostatic latent image, because of its low surface potential at the time of transfer of that electrostatic latent image, thus presenting the same characteristic as that of the area which has traced a history of exposure to charge neutralizing, charging, exposure to a projected optical image pattern, and exposure to charge neutralizing, i.e., the characteristic represented by a curve 01-02-A-D-E-H. Accordingly, the sensitivity of the area of the photosensitive drum which corresponds to the black portion of the beginning half differs from the sensitivity of the area corresponding to the white portions. As a result, a pattern obtained in the beginning half of a copy appears again later over the copied pattern in a superimposed relation.

The phenomena of the stained copied patterns as has been described under the foregoing paragraphs (1) to (3) may be summarized as follows: The foggy effect, i.e., fogging in the beginning half of the copied pattern is caused by the difference in the characteristics represented by the curves E-H and E-F in FIG. 1. The occurrence of the black mesh pattern in the intermediate areas of the copy is attributable to the difference in characteristics represented by the curves E-H and E-F. The memory effect of later portions of the copy is caused by the difference in characteristics represented by the curves E-H and E-G.

The instant inventors have studied the problem and have discovered the foregoing phenomenon for stained copied patterns. They now provide the present invention as a solution to this problem.

The present invention presents an electrophotographic process of the type in which the electrostatic image is formed on the surface of an endless photosensitive member, which member exhibits a hysteresis effect, in conformity with an original pattern through the steps of radiating light on the member to neutralize charges, charging and exposure to a projected optical image pattern, the aforesaid process being characterized by the inclusion of an additional step of rendering the distribution of charges on the surface of the endless photosensitive member uniform. This additional step is an effort to prevent the occurrence of the foregoing stained copied pattern. The aforesaid additional step of rendering charges uniform over the surface of the endless photosensitive member is accomplished by using a uniformly charging means for the photosensitive member which exhibiting hysteresis, such as that of a $CdS \cdot nCdCO_3$ resin photosensitive member. In this manner, the sensitivity of the photosensitive member is improved as well.

A description will now be given of the embodiments shown in FIGS. 3 and 4 of the drawing. In these embodiments, the electrophotographic process according to the present invention is applied to a generally conventional electrostatic latent image transfer copying machine using the prior art electrophotographic process as shown in the portions of FIG. 2. In this respect, like parts are designated with like reference numerals throughout FIGS. 2, 3 and 4.

Figure 3:
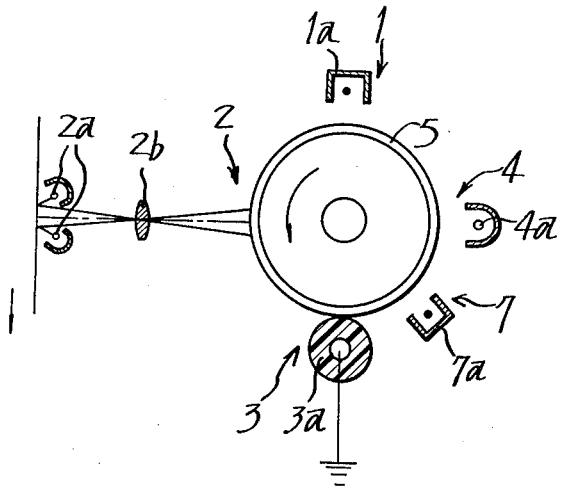
FIG. 3 is a cross-sectional view of the essential parts of an image forming station of an electrostatic-latent-image-transfer copying machine embodying an electrophotographic process according to the present invention.

In the electrostatic latent image transfer copying machine as shown in FIG. 3, a second corona discharger *7a* is positioned in the vicinity of the periphery of the endless photosensitive drum 5 between the transfer roller *3a* and the eraser lamp *4a* to charge the photosensitive drum 5 to the same potential as that of the corona discharger *1a*. The second corona discharger *7a* serves as a means 7 for rendering the distribution of charges on the surface of the photosensitive drum uniform. On the other hand, FIG. 4 represents a modification, in which the second corona discharger *7a* is provided in integral fashion to the eraser lamp *4a*. The aforesaid arrangement is the same as that shown in FIG. 2, except for the addition of the corona discharger *7a*, so that a duplicate description is omitted of the common parts.

The following description is given to show the prevention of the aforesaid phenomenon of stained copied patterns according to this embodiment of the invention. The description is broken in sections in correspondence with the aforesaid paragraphs (1), (2) and (3) so that direct comparisons may be made.

1'. The area ranging from the point $a_1$ to the point $b_2$ on the surface of the transfer copy paper:

The histories of the portions of the photosensitive drum 5 which correspond to the aforesaid area and the area from the point $a_2$ and beyond on the surface of the transfer paper are both given as the sequence steps of charging and exposure to charge neutralizing. Thus, these portions of the photosensitive ember exhibits the same characteristic represented by the curve E-H from FIG. 1, so that there takes place no difference in density and no fogging occurs.

2'. The area ranging from the point $b_2$ to the point $a_2$ on the surface of the transfer copy paper:

The nonuniformity in the neutralization of charges due to the grounded transfer roller which is responsible for the previous occurrence of the black mesh pattern is eliminated by the uniform charging prior to exposure to charge neutralizing. Hence, such a black mesh pattern does not result. On the other hand, the history of the photosensitive drum which corresponds to the aforesaid area is given as the steps of charging and exposure to charge neutralizing, i.e., the drum again exhibits a characteristic represented by the curve E-H.

3'. The area from the point $a_2$ and beyond on the surface of the transfer copy paper:

The lowering of the surface potential on the drum due to an electrostatic transfer which is responsible for the superimposed printing of copied patterns is likewise eliminated as in the aforesaid case (2'). Hence, there results no super-imposed printing of copied patterns. Likewise, the photosensitive drum in this area again exhibits a light decay characteristic represented by the curve E-H of FIG. 1.

As is apparent from the foregoing, with the copying machine which is shown in FIG. 3 and to which is applied the electrophotographic process according to the present invention, the occurrence of the phenomenon of a stained copied pattern is prevented while the photosensitive member may be used at its highest sensitivity.

In the embodiment shown in FIG. 3, the corona discharger *7a* should charge the surface of the photosensitive member to a uniform surface potential and is preferably of the scorotron type of discharger. Even in the case where an ordinary corotron type discharger is employed, there may be achieved very significant improvements. In other words, it was found that a strict uniformity of the distribution of charges is not necessarily required for effectively rendering charges on the surface of an endless photosensitive member uniform.

In addition, in cases other than the use of a drum of a small diameter as a photosensitive member, the electrophotographic process according to the present invention may effectively prevent the occurrence of the phenomenon of a stained copied pattern which accrues from continuous copying at a high speed. In addition, the electrophotographic process according to the present invention is by no means limited to the aforesaid $CdS \cdot nCdCO_3$ resin photosensitive member. It is applicable generally to any photosensitive member which exhibits a hysteresis similar to that described above for the $CdS \cdot nCdCO_3$ resin photosensitive member where that member is used repeatedly in an image forming step. For example, photosensitive members in which poly-N-vinylcarbazole and a photoconductor are laminated together. (In the latter member, its way of exhibiting a hysteresis varies depending upon the manufacturing conditions, its service condition, and the like.) In addition, the process according to the present invention is applicable even to a photosensitive member which exhibits a relationship between its history and the light decay rate which is in an inverse manner to that of the $CdS \cdot nCdCO_3$ resin photosensitive member, so long as the aforesaid photosensitive member exhibits a pronounced hysteresis.

On the other hand, in an electrostatic latent image transfer copying machine any delicate change in an electrostatic image formed tends to be reproduced. Therefore, a stained copied pattern immediately results. However, even with other developed toner image transfer copying machines, there may arise a memory effect. It has been proven that the electrophotographic process according to the present invention is effective in these instances as well.

The following examples are illustrative of the features of the electrophotographic process according to the present invention. In these examples, numerous tests have been performed to compare the process with the prior art electrophotographic processes.

EXAMPLE 1

Figure 5:
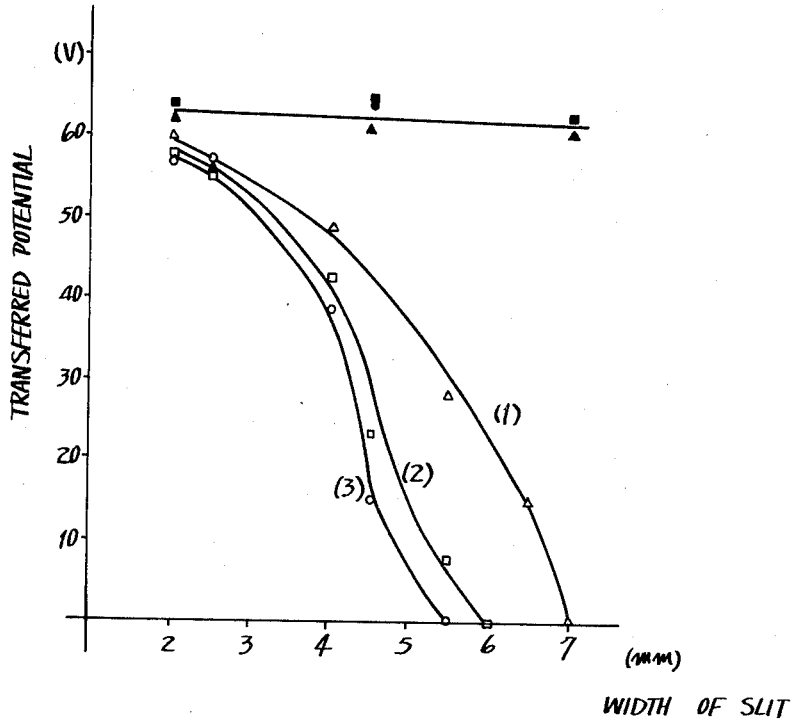
FIGS. 5 through 8 are a series of plots showing the results of various tests performed by the inventors which are useful for showing the advantages of the present invention.

FIG. 5 shows the results of measurements of electrostatic image charges on those areas of the surface of the transfer copy paper which correspond to the white portion (density 0.1) and the black portion (density 2.5) of an original. In this case, however, the copying machine as shown in FIG. 2 was used. The exposure illuminance of the area of the photosensitive member which corresponds to the white portion (density 0.1) of an original is set to 100 lx, and the illuminance for neutralizing charger after the electrostatic image transfer was set to 130 lx (width of slit —5 mm). An electrostatic recording paper of an electrostatic capacity of 510 $pF/cm^2$ was used as a transfer copy paper. The ordinate represents the electrostatic image latent charge on the transfer paper, while the abscissa represents the width of a slit for use with the portion of the optical image to be exposed of the photosensitive member.

In this figure, the marks ▲/△ represent measurements of electrostatic latent image charges corresponding to the black/white portion of a pattern of an original on the surface of a transfer paper ranging from the point $a_2$ to the point $b_2$. The marks ●/■ represent the measurement of electrostatic latent image charges which correspond to the black portion of an original pattern, in the area from the point $a_2$ and beyond on the surface of the transfer paper, whose image has been formed by the photosensitive surface of the photosensitive member which surface has been used for forming an image in conformity with the black/white portion of an original pattern during the first cycle of rotation of the photosensitive member. The marks ○/□ represent the measurements of electrostatic latent image charges which correspond to the white portion of an original pattern in the area from the point $a_2$ and beyond on the surface of the transfer paper whose images have been formed by the photosensitive surface of the photosensitive member which surface had been used for forming images in conformity with the white/black portion of an original pattern during the first cycle of rotation of the photosensitive drum.

In this case, the foggy effect is represented as the difference in the transferred potentials between the curve (1) and the curve (2). The memory effect is represented as the difference in the transferred potential between the curve (2) and the curve (3).

A further detailed description will be given of this phenomenon. The transferred potentials in the area of the transfer paper which correspond to the white portion in an original pattern vary depending on the difference in history of the photosensitive member even under the same condition as shown by the curves (1), (2) and (3). For example, in the case of copying with a slit width set to over 7 mm so as to nullify the transferred potential in the area from the point $a_1$ to the point $b_2$ on the surface of a transfer paper, the portion of a low density in an original pattern fails to be reproduced for the area from the point $a_2$ and beyond on the surface of the transfer copy paper. (The transferred potential corresponding to the low density portion of an original pattern is brought to OV.) To prevent this, if the copying is effected, with the width of a slit set on the order of 6 mm, then an image on the area from the point $a_2$ and beyond of the surface of the transfer paper, which correspond to the low density portion of an original pattern may be reproduced. The transferred potential in the area ranging from the point $a_2$ to the point $b_2$, of the surface of the transfer paper, which correspond to the white portion of an original pattern is brought to about 20 V resulting in fogging. In addition, as shown by the curves (2) and (3), even in the area from the point $a_2$ and beyond of the surface of a transfer paper which corresponds to the white portion of an original pattern, there appear different transferred potentials which correspond to original patterns of the same density. This results in superimposed copied patterns depending on whether or not the surface of the photosensitive drum has been used for forming images in conformity with a white portion or a black portion of an original pattern during the first cycle of rotation of the photosensitive drum.

EXAMPLE II

Figure 4:
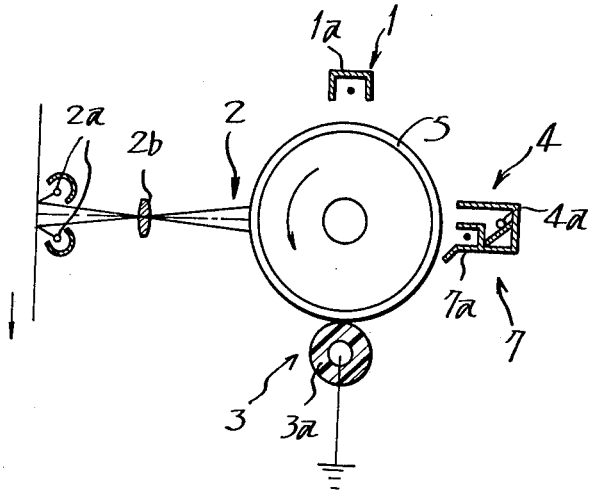
FIG. 4 is a cross-sectional view illustrating one modification of the electrostatic-latent-image-transfer copying machine shown in FIG. 3.
Figure 6:
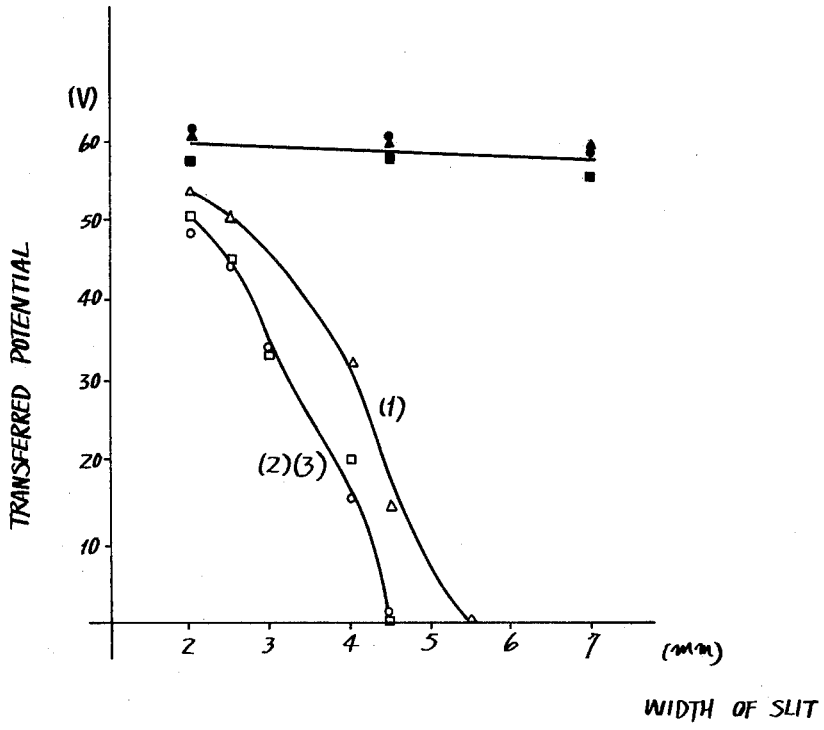

FIG. 6 shows the results of a series of tests in which the electrophotographic process according to the present invention is applied to a copying machine under the same conditions as in the case of the Example 1 with a corona discharger of a corotron type positioned as shown in FIG. 4 in integral fashion to an eraser lamp. A comparison with the Example I shows that the memory effect is completely eliminated, and the respective curves are shifted to the left relatively presenting significant improvement in sensitivity. Meanwhile, there was noted a foggy effect which may be attributed to an insufficient charging capability of the corona discharger used in this test during the first cycle of the rotation of a photosensitive drum. Accordingly, an increase in the charging capability of the discharger during the first cycle of the rotation of the photosensitive drum or the use of a corona discharger of a scorotron type brings the curve (1) into closer register with the curves (2) and (3). In addition, simply for prevention of the foggy effect, the brightness of an original pattern illuminating lamp or the slit width in the portion to be exposed of the photosensitive drum may be adjusted in cooperation with the rotation of the photosensitive drum to further alleviate this problem.

EXAMPLE III

Figure 7:
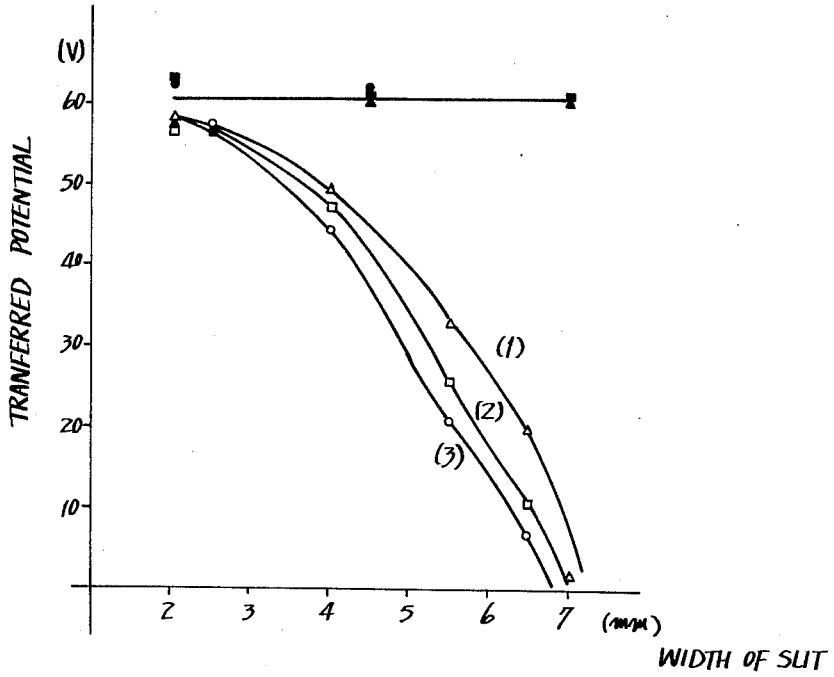

FIG. 7 shows the results of tests, in which the illuminance used for charge neutralizing was set to 700 lx under the same conditions as in the case of the Example I. The comparison with the Example I reveals that the difference in transferred potentials among the curves (1), (2) and (3) is lessened and the occurrences of foggy effect as well as the memory effect are somewhat prevented although the sensitivity is lowered.

EXAMPLE IV

Figure 8:
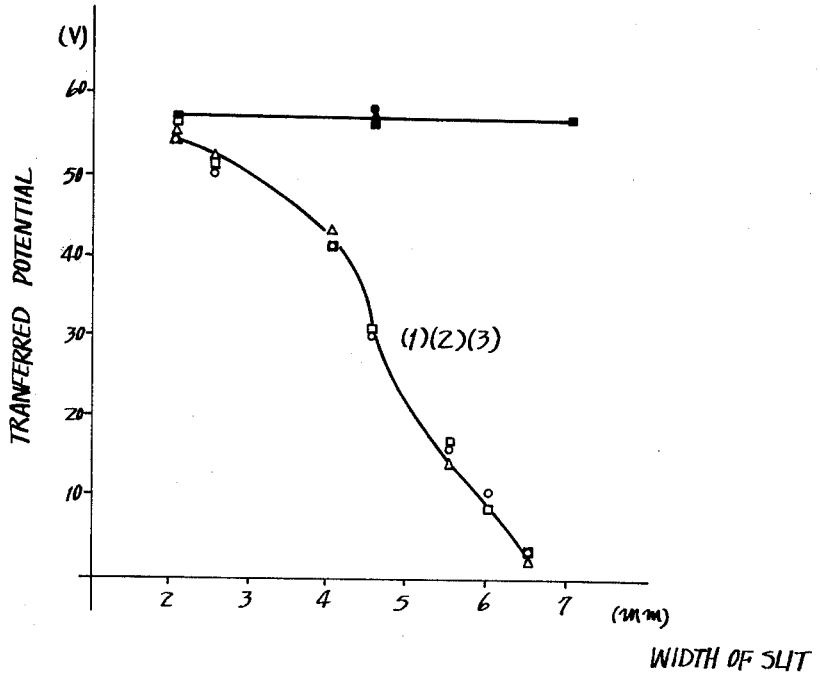

FIG. 8 shows the results of tests, in which a corona discharger is used, as in the case of Example II, under the same conditions as that of Example III. The comparison with Example III shows that the curves (1), (2) and (3) are completely in coincidence with each other, while the foggy effect as well as the memory effect are completely eliminated together with an increase in sensitivity.

As is apparent from the foregoing description, if a charging step according to the corona discharger is added as a preliminary step to the charge neutralizing step, the curves (1) and (2) are brought into registery with the curve (3) so that the occurrence of the phenomenon of a stained copied pattern due to a difference in history is alleviated or eliminated. In addition, photosensitive members presenting a relationship between history and a light decay rate which is similar to that relationship in the $CdS \cdot nCdCO_3$ resin photosensitive member as used in the tests herein may be used at the highest sensitivity.

While there have been described and illustrated preferred embodiments of the present invention, it will be apparent to those ordinarily skilled in the art that numerous alterations, omissions and additions may be made therein without departing from the spirit thereof.

We claim:

1. An electrophotographic copier comprising;

a rotatable photosensitive member which exhibits a hysteresis effect in which the photosensitivity of the photosensitive member when exposed by an image exposing means varies in accordance with the variance of the surface potential of the member at the start of light decay by an erasing lamp;

means disposed around said photosensitive member in the following order and including;

a first corona discharger for charging said photosensitive member uniformly with charges of a specific polarity to a predetermined surface potential;

means for exposing an image corresponding to an original onto the uniformly charged photosensitive member;

image transfer means for transferring the image on the photosensitive member onto a copy material;

a second corona discharger for uniformly charging the photosensitive member with charges of a polarity the same as the polarity of the charges of said first corona discharger and to a potential substantially the same as the potential applied by said first corona discharger;

an erasing lamp for erasing charges on the photosensitive member;

whereby said second corona discharger guarantees a high and constant photosensitivity of the photosensitive member by preventing variances of the photosensitivity of the photosensitive member at image exposure by said image exposing means.

2. An electrophotographic copier comprising;

a rotatable photosensitive member including $CdS \cdot nCdCO_3$ ($0 < n \leqq 4$) which exhibits a hystereis effect in which the photosensitivity of the photosensitive member when exposed by an image exposing means varies in accordance with variance of surface potential at the start of light decay by an erasing lamp which may cause stained copy patterns;

means disposed around said photosensitive member in the following order and including;

a first corona discharger for charging the photosensitive member uniformly with charges of a specific polarity to a predetermined surface potential;

means for exposing an image corresponding to an original onto the uniformly charged photosensitive member such that an electrostatic latent image is formed on the photosensitive member;

image transfer means for transferring said electrostatic latent image on the photosensitive member onto a copy material;

a second corona discharger for uniformly charging the photosensitive member with charges of a polarity the same as the polarity of the charges charged by said first corona discharger and to a potential substantially the same as the potential charged by said first corona discharger;

an erasing lamp between said second and first corona discharger for erasing charges on the photosensitive member;

whereby said second corona discharger guarantees a high and constant photosensitivity of the photosensitive member by preventing variances of the photosensitivity of the photosensitive member at image exposure by said image exposing means.

3. An electrophotographic copier comprising;

a rotatable photosensitive member including $CdS \cdot nCdCO_3$ ($0 < n \leqq 4$) which exhibits a hysteresis effect in which the photosensitivity of the photosensitive member when exposed by an image exposing means varies in accordance with the variance of the surface potential at the start of light decay by an erasing lamp in such a manner that previous history of the member may influence the photosensitivity of the photosensitive member at exposure by an image exposing means to thereby cause stained copy patterns;

means disposed around said photosensitive member in the following order and including;

a first corona discharger for charging the photosensitive member uniformly with charges of specific polarity to a predetermined surface potential;

means for exposing an image corresponding to an original onto the uniformly charged photosensitive member such that an electrostatic latent image is formed on the photosensitive member;

image transfer means for transferring said electrostatic latent image on the photosensitive member onto a copy material;

a second corona discharger for uniformly charging the photosensitive member with charges of polarity the same as the polarity of the charges applied by said first corona discharger and to a potential substantially the same as the potential charged by said first corona discharger;

an erasing lamp disposed between said second and first corona discharger for erasing charges applied by said second corona discharger;

whereby said second corona discharger renders the surface potential at the start of light decay by the erasing lamp to a high and uniform degree thereby guaranteeing the high and constant photosensitivity of a photosensitive member at the image exposure.

* * * * *

UNITED STATES PATENT OFFICE

CERTIFICATE OF CORRECTION

PATENT NO. : 4,063,811

DATED : December 20, 1977

INVENTOR(S) : Kuniki Seino and Shoji Kondo

It is certified that error appears in the above-identified patent and that said Letters Patent are hereby corrected as shown below:

[30] Foreign Application Priority Data

April 11, 1975 Japan.....50-44492

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*